United States Patent [19]

Lin

[11] Patent Number: 4,639,115

[45] Date of Patent: Jan. 27, 1987

[54] DEVELOPMENT APPARATUS WITH PAPER DEBRIS REMOVER

[75] Inventor: Ying-wei Lin, Penfield, N.Y.

[73] Assignee: Xerox Corporation, Stamford, Conn.

[21] Appl. No.: 718,615

[22] Filed: Apr. 1, 1985

[51] Int. Cl.[4] ..... G03G 15/08

[52] U.S. Cl. ..... 355/3 DD; 355/14 D; 118/652

[58] Field of Search ..... 355/300, 14 D, 15; 118/652, 639, 657

[56] References Cited

U.S. PATENT DOCUMENTS

| | | | |
|---|---|---|---|
| 3,572,923 | 3/1971 | Fisher et al. | 355/15 |
| 3,722,018 | 3/1973 | Fisher | 15/1.5 |
| 4,265,990 | 5/1981 | Stolka et al. | 430/59 |
| 4,351,604 | 9/1982 | Karasawa et al. | 355/3 DD X |
| 4,357,097 | 11/1982 | Koiso | 355/3 DD X |
| 4,494,863 | 1/1985 | Laing | 355/15 |

*Primary Examiner*—A. C. Prescott

[57] ABSTRACT

Apparatus for purifying toner prior to its use in developing latent electrostatic images. An electrically biased roll supported in the developer housing contiguous at least one of the development rolls serves to attract paper debris from the toner contained in the toner carried by the developer roll. The roll is fabricated from a suitable insulating material and electrically biased in a manner suitable for attracting the paper debris contained in the toner. The roll is rotated and a scraper blade is provided for removing the debris therefrom. The debris so removed is allowed to fall into a toner catch tray which can be provided with an auger for moving it out of the tray to thereby increase the capacity of the system for debris removal.

10 Claims, 2 Drawing Figures

DEVELOPMENT APPARATUS WITH PAPER DEBRIS REMOVER

BACKGROUND OF THE INVENTION

This invention relates to printing machines, and more particularly, to a toner development apparatus for developing latent electrostatic images on a charge-retentive surface and, more particularly, to the purification of the toner in the development housing of the development apparatus prior to its being presented to latent electrostatic images formed on the charge-retentive surface to thereby render the latent electrostatic image visible.

In the art of xerography or other similar image reproducing arts, a latent electrostatic image is formed on a charge-retentive surface such as a photoconductor which generally comprises a photoconductive insulating material adhered to a conductive backing. The photoconductor is first provided with a uniform charge after which it is exposed to a light image of an original document to be reproduced. The latent electrostatic images, thus formed, are rendered visible by applying any one of numerous pigmented resins specifically designed for this purpose. In the case of a reusable photoconductive surface, the pigmented resin, more commonly referred to as toner which forms the visible images, is transferred to plain paper.

It should be understood that for the purposes of the present invention, which relates to the development of latent electrostatic images with toner particles, the latent electrostatic image may be formed by means other than by the exposure of an electrostatically charged photosensitive member to a light image of an original document. For example, the latent electrostatic image may be generated from information electronically stored or generated, and the digital information may be converted to alphanumeric images by image generation electronics and optics. However, such image generation electronic and optic devices form no part of the present invention.

I have observed that paper debris in the development apparatus forms agglomerates with the toner particles or broadens the toner charge distribution. When either of the foregoing phenomena occurs excessive background development occurs. In other words, the electrostatic image on the charge-retentive surface in the non-image (i.e. background areas) attracts an undesirable quantity of toner thereto thereby causing the finished copies to have an unpleasing appearance. Moreover, with the presence of the debris in the toner, it is undesirable to recycle for reuse the residual toner removed from the charge-retentive surface.

The use of an electrostatic field in attracting toner from a charge-retentive surface has been known for some time. Arrangements for such purposes are disclosed in U.S. Pat. Nos. 3,572,923 and 3,722,018 granted to Fisher et al on Mar. 22, 1973 and Fisher on Mar. 30, 1971, respectively. The use of electrostatic attraction of toner in development systems is also well known.

The problem of not being able to recycle the residual toner for reuse has been satisfactorily solved as disclosed in U.S. Pat. No. 4,494,863 issued in the name of John R. Laing and assigned to the same assignee as the instant application. As disclosed therein, debris such as paper fibers and Kaolin are removed from the residual toner so that the toner is suitable for reuse. The foregoing is accomplished by electrostatically attracting the debris and Kaolin from a residual toner removing roll. This is effected by means of an electrically biased detoning roll which is supported contiguous the toner removing roll. I am not aware of the use of electrostatic forces for purifying toner prior to its use for developing latent electrostatic images on a charge-retentive surface wherein the purification actually takes place in the developer apparatus.

SUMMARY OF THE INVENTION

Pursuant to the solution of the problems which I have encountered as outlined above, I have provided an electrically biased roll supported in the developer housing contiguous at least one of the development rolls. The roll is fabricated from a suitable insulating material and electrically biased in a manner suitable for attracting paper debris contained in the toner. The roll is rotated and a scraper blade is provided for removing the debris therefrom. The debris so removed is allowed to fall into a toner catch tray which can be provided with an auger for moving it out of the tray to thereby increase the capacity of the system for debris removal.

DETAILED DESCRIPTION OF THE DRAWINGS

Figure 1:
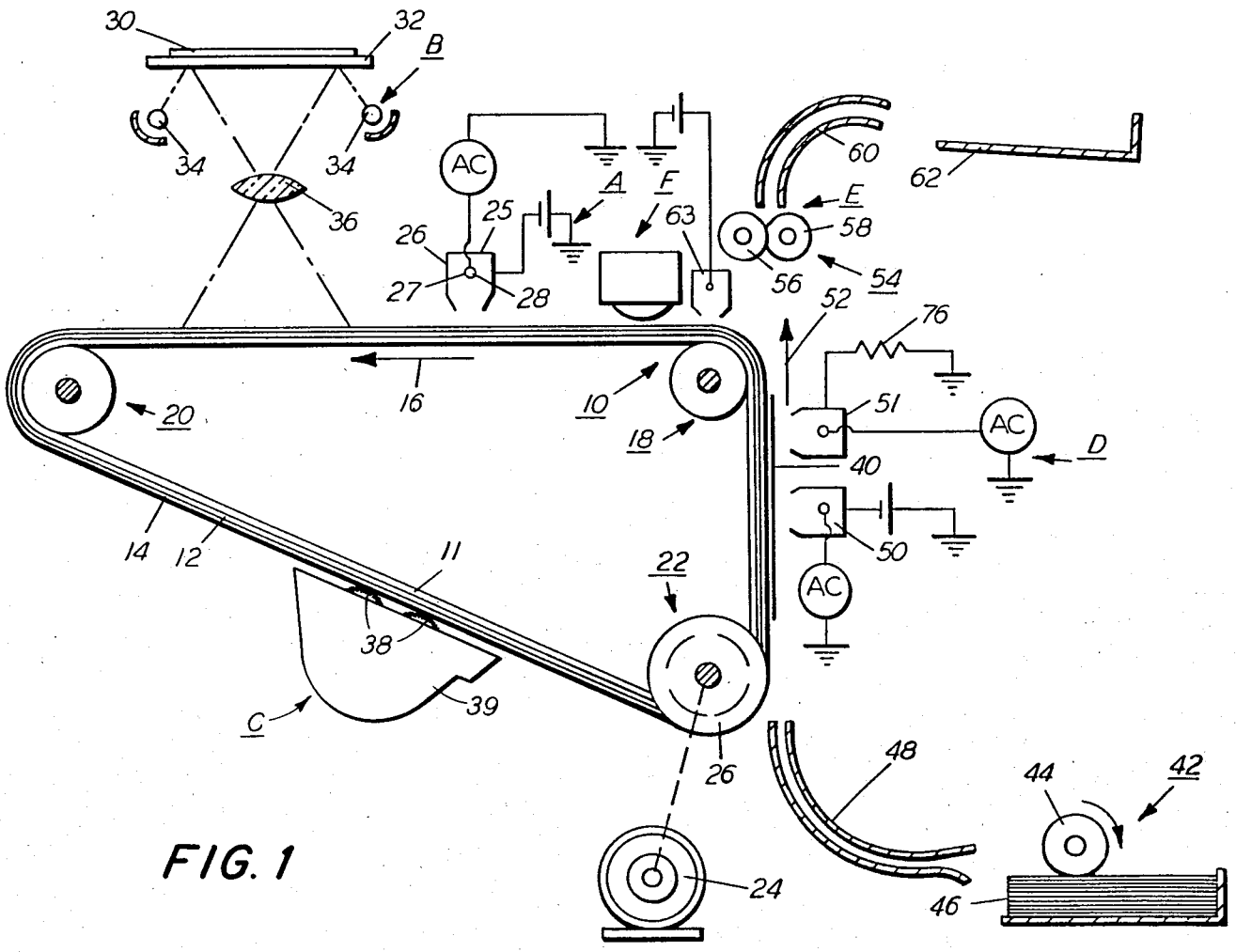
Figure 2:
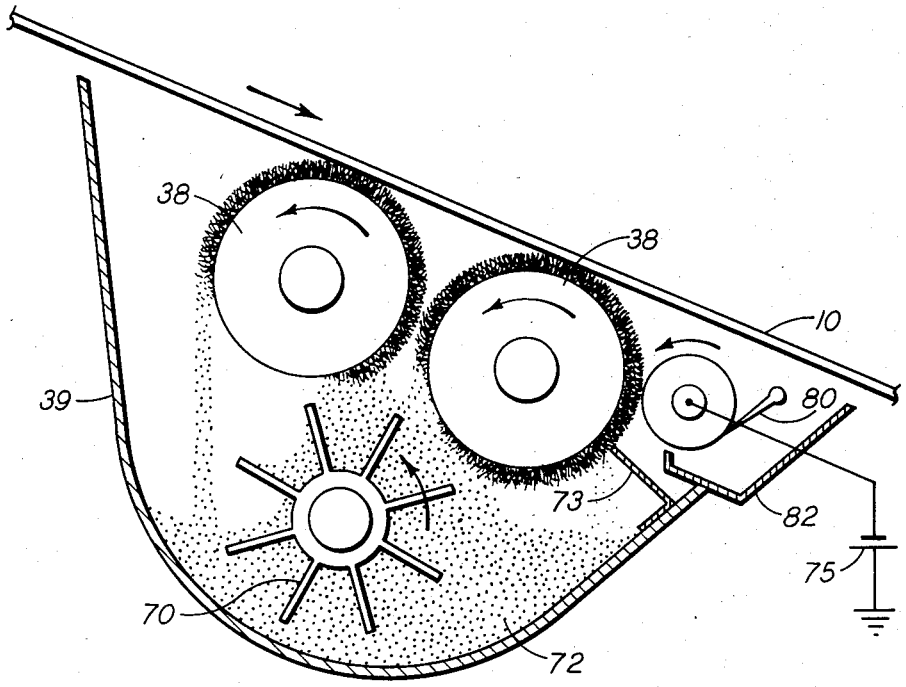

Other aspects of present invention will become apparent as the following description proceeds with reference to the drawings wherein:

FIG. 1 is a schematic elevational view depicting an electrophotographic printing machine incorporating the present invention; and FIG. 2 is an enlarged schematic view of the developer apparatus of the present invention

DETAILED DESCRIPTION OF THE INVENTION

Inasmuch as the art of the electrophotographic printing is well known, the various processing stations employed in the printing machine illustrated in FIG. 1 will be described only briefly.

As shown in FIG. 1, the printing machine utilizes a photoconductive belt 10 which consists of an electrically conductive substrate 11, a charge generator layer 12 comprising photoconductive particles randomly dispersed in an electrically insulating organic resin and a charge transport layer 14 comprising a transparent electrically inactive polycarbonate resin having dissolved therein one or more diamines. A photoconductive belt of the foregoing type is disclosed in U.S. Pat. No. 4,265,990 issued May 5, 1981 in the name of Milan Stolka et al, the disclosure of which is incorporated herein by reference. Belt 10 moves in the direction of arrow 16 to advance successive portions thereof sequentially through the various processing stations disposed about the path of movement thereof. Belt 10 is entrained about stripping roller 18, tension roller 20 and drive roller 22. Roller 22 is coupled to motor 24 by suitable means such as a drive chain. Belt 10 is maintained in tension by a pair of springs (not shown) which resiliently urge tension roller 20 against belt 20 with the desired spring force. Both stripping roller 18 and tension roller 20 are rotatably mounted. These rollers are idlers which rotate freely as belt 10 moves in the direction of arrow 16.

With continued reference to FIG. 1, initially a portion of belt 10 passes through charging station A. At charging station A, a corona device indicated generally by reference numeral 25 charges the layer 12 of belt 10 to a relatively high, substantially uniform negative potential.

A suitable corona generating device for negatively charging the photoconductive belt 10 comprises a conductive shield 26 and corona wire 27, the latter of which is coated with an electrically insulating layer 28 having a thickness which precludes a net d.c. corona current when an a.c. voltage is applied to the corona wire when the shield and photoconductive surface are at the same potential.

Next, the charged portion of the photoconductive belt is advanced through exposure station B. At exposure station B, an original document 30 is positioned face down upon a transparent platen 32. The light rays reflected from original document 30 form images which are transmitted through lens 36. The light images are projected onto the charged portion of the photoconductive belt to selectively dissipate the charge thereon. This records an electrostatic latent image on the belt which corresponds to the information area contained within original document 30.

Thereafter, belt 10 advances the electrostatic latent image to development station C. At development station C, a pair of magnetic brush developer roller 38 disposed in a developer housing 39 advances a developer mix (i.e. toner and carrier granules) into contact with the electrostatic latent image. The latent image attracts the toner particles from the carrier granules thereby forming toner images on the photoconductive belt.

Belt 10 then advances the toner powder image to transfer station D. At transfer station D, a sheet of support material 40 is moved into contact with the toner powder images. The sheet of support material is advanced to transfer station D by a sheet feeding apparatus 42. Preferably, sheet feeding apparatus 42 includes a feed roll 44 contacting the upper sheet of stack 46. Feed roll 44 rotates so as to advance the upper most sheet from stack 46 into chute 48. Chute 48 directs the advancing sheet of support material into contact with the belt 10 in a timed sequence so that the toner powder image developed thereon contacts the advancing sheet of support material at transfer station D.

Transfer station D includes a corona generating device 50 which sprays ions of a suitable polarity onto the backside of sheet 40 so that the tone powder images are attracted from photoconductive belt 10 to sheet 40. After transfer, the sheet continues to move in the direction of arrow 52 onto a conveyor (not shown) which advances the sheet of fusing station E.

Fusing station E includes a fuser assembly, indicated generally by the reference numeral 54, which permanently affixes the transferred toner powder images to sheet 40. Preferably, fuser assembly 54 includes a heated fuser roller 56 adapted to be pressure engaged with a back-up roller 56 adapted to be pressure engaged with a back-up roller 58 with the toner powder images contacting fuser roller 56. In this manner, the toner powder images are permanently affixed to sheet 40. After fusing, chute 60 guides the advancing sheet 40 to catch tray 62 for removal from the printing machine by the operator.

A preclean dicorotron 63 is provided for exposing the residual toner and contaminants to positive charges to thereby narrow the charge distribution thereon so that a negatively biased cleaning roller or brush 64, to be discussed hereinafter, will be more effective in removing them.

At the cleaning station F, residual toner and contaminants or debris such as paper fibers and Kaolin are removed from the photoreceptor surface by means of brush 64 which is preferably a captive magnetic brush structure which is negatively biased by means of a power source (not shown) and which is rotated in the direction of the arrow 66 via a motor (not shown). In a xerographic or similar type system of the type herein disclosed, the brush 64 will remove the residual toner from the photoreceptor.

As disclosed in FIG. 2, the development system of the present invention comprises the developer rollers 38 which are supported adjacent the photoreceptor 10. A paddle wheel 70 is rotatably supported in the housing 39 and serves to move developer 72 contained in the housing 39 into contact with the developer rollers 38 which, in turn, delivers the developer mixture to the photoreceptor 10. A trim bar 73 is provided for maintaining the toner at the desired height on the roller 38.

A purification roll 74 rotatably supported in the developer housing 39 adjacent the developer roll 38 serves to electrostatically attract paper debris from the developer 72 prior to the delivery of the developer to the photoreceptor 10. The roll 74 is electrically biased by voltage source 75 to a suitable level in order to create an electrostatic field of sufficient magnitude to effect the aforementioned attraction. The bias level will vary depending on the type of developer used and the electrical bias on the developer roll 38, if any. The purification roll is preferably fabricated from an insulator material or has its surface rendered insulative in any suitable manner, for example, as by anodizing a non-insulative roll. A blade 80 scrapes the paper debris from the purification roller 80 and a catch tray 82 is supported below the roll for receiving the paper debris.

I claim:

1. Apparatus for rendering latent electrostatic images on a charge-retentive surface visible, said apparatus comprising:

means containing a quantity of developer;

at least one magnetic developer roll rotatably supported for rotation in a predetermined direction intermediate said charge retentive surface and said developer containing means;

means for moving developer material from said containing means to said magnetic developer roll, said developer roll being positioned adjacent said charge retentive surface whereby developer carried thereby is presented to said charge retentive surface during rotation of said developer roll; and paper debris removal means supported adjacent said magnetic developer roll in a location relative to the developer roll's path of travel whereby a section of said developer roll to which developer material has been attracted is moved by said developer roll into contact with said paper debris removal means prior to contactng said charge retentive surface.

2. Apparatus according to claim 1 wherein said means for removing paper debris comprises an electrically biased roll.

3. Apparatus according to claim 2 wherein said electrically biased roll is an insulator.

4. Apparatus according to claim 3 including a scraper blade for removing said paper debris from said biased roll.

5. Apparatus according to claim 4 including a catch tray for holding paper fibers removed from said biased roll.

6. A printing machine including development apparatus for rendering latent electrostatic images visible on a charge-retentive surface, said apparatus comprising:

means containing a quantity of developer;

at least one magnetic developer roll rotatably supported for rotation in a predetermined direction intermediate said charge retentive surface and said developer containing means;

means for moving developer material from said containing means to said magnetic developer roll, said developer roll being positioned adjacent said charge retentive surface whereby developer carried thereby is presented to said charge retentive surface during rotation of said developer roll; and paper debris removal means supported adjacent said magnetic developer roll in a location relative to the developer roll's path of travel whereby a section of said developer roll to which developer material has been attracted is moved by said developer roll into contact with said paper debris removal means prior to contacting said charge retentive surface.

7. Apparatus according to claim 6 wherein said means for removing paper debris comprises an electrically biased roll.

8. Apparatus according to claim 7 wherein said electrically biased roll is an insulator.

9. Apparatus according to claim 8 including a scarper blade for removing said paper debris from said biased roll.

10. Apparatus according to claim 9 including a catch tray for holding paper fibers removed from said biased roll.

* * * * *